US005505163A

United States Patent [19]

Jameel

[11] Patent Number: 5,505,163

[45] Date of Patent: Apr. 9, 1996

[54] SOOTBLOWER NOZZLE

[76] Inventor: Mohomed I. Jameel, 1008C Oak Chase, Tucker, Ga. 30084

[21] Appl. No.: 210,321

[22] Filed: Mar. 18, 1994

[51] Int. Cl.[6] ..... F22B 37/18

[52] U.S. Cl. ..... 122/379; 122/390; 122/392; 122/405

[58] Field of Search ..... 122/379, 390, 122/392, 405

[56] References Cited

U.S. PATENT DOCUMENTS

| | | | |
|---|---|---|---|
| 4,492,187 | 1/1985 | Hammond | 122/390 |
| 4,565,324 | 1/1986 | Rebula et al. | 239/290 |
| 5,063,632 | 11/1991 | Clark et al. | 15/316.1 |
| 5,241,723 | 9/1993 | Garrabrant | 15/316.1 |
| 5,271,356 | 12/1993 | Kling et al. | 122/392 |
| 5,375,771 | 12/1994 | Jameel et al. | 239/567 |

OTHER PUBLICATIONS

Kuno Foelsch, "The Analytical Design of an Axially Symmetric Laval Nozzle for a Parallel and Uniform Jet" Jrnl. of the Aeronautical Sciences, Mar., 1949.

*Primary Examiner*—Henry A. Bennet
*Assistant Examiner*—Siddharth Ohri
*Attorney, Agent, or Firm*—Hopkins & Thomas

[57] ABSTRACT

A nozzle for a sootblower is used to project a cleaning agent against the internal surfaces of a boiler for removing fireside deposit. The nozzle of the present invention incorporates a passageway having a convergent segment between its entrance end most narrow point, the throat. Extending from the throat to the nozzle's exit is an expansion chamber in which the cleaning fluid passing therein expands and drops in pressure to substantially ambient pressure. The flow streams of the jet of the cleaning agent discharged from the nozzle is essentially parallel to the center axis of the nozzle. Additionally, the nozzles can be mounted diametrically opposed or spaced along the longitudinal axis of the lance tube. Moreover, the nozzles mounted in a lance tube can be mounted flush with the outside surface of the lance tube, contoured to its shape.

35 Claims, 7 Drawing Sheets

SOOTBLOWER NOZZLE

FIELD OF THE INVENTION

This invention generally relates to an improved sootblower nozzle and is more particularly concerned with a sootblower nozzle having improved cleaning effect over conventional nozzle designs.

BACKGROUND OF THE INVENTION

The accumulation of fireside deposits on the internal heating surfaces of boilers drastically reduces their thermal conductivity and efficiency and, if not removed, requires periodic shutdowns of the boiler for manual cleaning. The principal means for removing fireside deposit accumulation in boilers is a cleaning device known as a sootblower. A conventional sootblower typically consist of a lance tube having a plurality of nozzles which direct jets of a compressible cleaning agent under pressure, such as steam, gas or vapor, sidewise from the lance against the internal surfaces of the boiler. The cleaning effectiveness of a sootblower depends to a great degree on the nozzle design which controls the mass flow, exit speed and the jet decay characteristics of the exiting jets.

The sootblower nozzle design most commonly used today is based on the de Laval design comprising convergent and conical divergent flow sections which form a venturi. The pressure of the cleaning agent decreases as it passes through the convergent segment of the nozzle, attaining the local speed of sound at the throat of the nozzle. The pressure of the cleaning agent then decreases further through the conical expansion section, expanding and accelerating from the nozzle throat to the nozzle exit and thereby typically exceeding the speed of sound as the cleaning agent exits. The pressure drop over the expansion section is controlled by the designed geometry of that section, primarily the divergence angle and length. Conventional belief is that the optimum divergence angle is about 15° or less so as to prevent the attendant generation of turbulence.

The cleaning potential of the jet emitted from a nozzle is commonly measured in terms of the jet's Peak Impact Pressure (PIP). The maximum PIP is delivered by nozzles where the pressure of the cleaning agent jet exiting the nozzle jet equals the ambient pressure surrounding the lance tube, thereby resulting in a "fully expanded" jet. Nozzles which allow the pressure of the exit jet to be greater than the ambient pressure result in an "under expanded" jet. In the case of under expanded jets, the pressure of the exiting jet is higher than the ambient pressure so the exiting jet must finish expanding outside the nozzle causing a series of expansion and contraction waves called "shock waves." These "shock waves" convert a substantial part of the kinetic energy of the jet stream into internal energy, thereby markedly reducing the PIP.

A "full expansion" nozzle is achieved by designing the nozzle with a specific ratio between the area of the nozzle's exit to the area of the nozzles's throat. The ratio is determined by the particular nozzle inlet pressure. In practice, this means the length of the expansion segment of the nozzle, $L_n$, needs to be extended to allow for the full expansion and the corresponding drop in pressure of the cleaning agent down to the ambient pressure at the nozzle's exit. However, the size of the sootblower lance tubes as well as the openings in the boiler wall through which the lance tube is inserted limit the elongation of conventional nozzles to achieve full expansion. This is shown in Table I where the prior art full expansion nozzle requires a nozzle length of approximately 3.5 to 5.0 inches. However, the inside diameter of the lance tube to which these nozzles are attached is only about 3.0 inches, restricting conventional nozzle lengths to approximately 1.63 inches. Furthermore, the sleeve diameter of the opening in the boiler wall through which the lance tube is inserted dramatically restricts the projection of the nozzle outside the lance tube. Table I below gives a comparison of the nozzle lengths of conventional nozzles which are under expanded and the same nozzle made full expansion.

TABLE I

| Nominal Size (in.) | Throat Area (in.$^2$) | Flow Rate* (lbs/sec.) | Conventional Under Expanded Nozzle Length (in.) | Full Expansion Nozzle Length (in.) |
|---|---|---|---|---|
| ⅞ | 0.601 | 2.24 | 1.63 | 3.45 |
| 1 | 0.785 | 2.93 | 1.63 | 3.86 |
| 1 ⅛ | 0.994 | 3.71 | 1.63 | 4.95 |

*For 300 psi inlet pressure and 600° F. superheated stewn.

Consequently, the shorter under expanded nozzles are used in conventional sootblowers. These circumstances are most apparent with the so called long retractable sootblowers, such as the one disclosed in European Patent No. 159,128. The sootblower of the '128 patent uses a lance tube typically having a plurality of under expanded nozzles at its working end which are generally positioned opposite to each other, with aligned center axes or slightly staggered center axes in order to offset the jet reaction forces, as seen in FIG. 2 of the '128 patent.

A nozzle designed to emulate the characteristics of a full expansion nozzle while having dimensions allowing it to be incorporated into a sootblower lance tube is disclosed in U.S. Pat. No. 5,271,356 to Kling et al. The nozzle device taught in the '356 patent utilizes a plug mounted to the back wall of the lance tube or supported by a radially extending support vane, as seen in FIGS. 4 and 5 of the '356 patent. Inherent with such a design is the workmanship involved in fabricating and mounting the plug and nozzle outer shell. Moreover, the plug must remain concentric in respect to the nozzle outer shell or the nozzle performance is diminished.

BRIEF DESCRIPTION OF THE INVENTION

Briefly described, the present invention includes a one piece sootblower nozzle which produces a substantially fully expanded jet of a compressible cleaning agent with the mass flow comparable to conventional nozzles. The sootblower nozzle of the present invention includes a confined, open and generally cylindrical passageway comprising, in coaxial relationship, an upstream entrance portion, a throat, an expansion chamber or portion and a downstream discharge end. The entrance portion has an entrance passageway which is defined by a convergent inner surface which merges with a cylindrical throat and through which the cleaning agent is discharged, thereby obtaining the speed of sound. The expansion chamber and the discharge end of the nozzle are of a designed geometry such that the cleaning agent passing through the expansion chamber of the nozzle expands rapidly in the vicinity of the throat so as to obtain the full expansion at or prior to the time that the gas passes out of the discharge end of the nozzle.

To achieve the controlled early expansion of the cleaning agent, a first embodiment of the present invention provides an abruptly larger cylindrical expansion chamber adjacent to and downstream of the nozzle throat which is defined by a reaction wall and an inner expansion surface of uniform diameter throughout its length. The sudden change in cross-sectional area in the passageway from the nozzle throat to the inner expansion surface of the expansion chamber causes the rapid expansion of the cleaning agent passing through the nozzle and the formation of a toroidal recirculating bubble of cleaning agent adjacent the throat where the reaction wall and inner expansion surface merge. The bulk of the cleaning agent flows over this toroidal recirculating bubble. In doing so, the cleaning agent of the primary flow steam expands through the expansion chamber of the nozzle.

In a second embodiment of the present invention, the controlled early expansion of the cleaning agent is produced by a companulate inner wall or surface defining the expansion chamber. The inner expansion surface is comprised of a conical portion defined by a divergence angle and, in cross-section, a curvilinear portion mathematically defined, The cleaning agent passing through the nozzle rapidly expands through the conical portion and is then redirected in the curvilinear portion. The expansion chamber merges with the discharge end portion.

In either embodiment described above, the slope of increments of the reaction wall of the expansion chamber, adjacent to the nozzle throat, varies between 90° and 10° with respect to the central axis of the nozzle. In addition, this slope of the reaction wall is essentially always greater than the slope of the inner expansion wall of the expansion chamber.

The nozzles of the present invention are disposed on opposite sides of a lance tube circumferentially spaced about 180° apart so as to discharge in opposite directions and along a common transverse center axis or slightly staggered along the longitudinal axis of the lance tube so as to allow for longer nozzles. Additionally, the nozzle of the present invention can be arcuate at its discharge end so as to be flush with the curviture of the outer surface of the lance tube.

Accordingly, it is an object of the present invention to provide a sootblower having a nozzle which substantially overcomes the disadvantages of under expansion and is suitable for use within the available space which accommodates a conventional sootblower.

Another object of the present invention is to provide a sootblower with a nozzle which is capable of efficiently generating a columnar jet stream of cleaning agent at a high velocity.

Another object of the present invention is to provide a sootblower having a nozzle that permits controlled expansion of the cleaning agent inside the nozzle and essentially eliminates shock waves in the jet.

Another object of the present invention is to provide a sootblower having a nozzle that provides for rapid expansion of the cleaning agent within the expansion chamber of the nozzle and allows the nozzle to be as short as practical to fit in a sootblower.

Another object of the present invention is to provide a sootblower having a nozzle which produces a jet of cleaning agent flowing in a substantially uniform column parallel to the nozzle's central axis.

Another object of the present invention is to provide a sootblower having a nozzle which will produce a more concentrated jet than nozzles having conical divergent discharge passageways.

Another object of the present invention is to provide a sootblower having a nozzle with improved cleaning characteristics.

Another object of the present invention is to provide a sootblower having nozzles which will facilitate the discharging of a cleaning agent and which will clean more efficiently a greater area and will travel further into the boiler.

Another object of the present invention is to provide a more efficient sootblower nozzle which when effectively used will improve the boiler thermal efficiency.

Another object of the present invention is to provide a sootblower nozzle which, when used, will lengthen the time between boiler shutdowns for cleaning.

Another object of the present invention is to provide a sootblower nozzle that can be easily mounted as a replacement for nozzles of previously existing sootblowers.

Another object of the present invention is to provide a sootblower nozzle which eliminates the need for welding or mounting additional parts on a sootblower and is easily fabricated.

Another object of the present invention is to provide a sootblower nozzle which is inexpensive to manufacture, durable in structure and efficient in operation.

Another object of the present invention is to provide a sootblower nozzle which will fit blower tubes of various diameters.

Another object of the present invention is to provide a sootblower nozzle with improved cleaning capability and which will conserve the amount of the cleaning agent used.

Another object of the present invention is to provide a sootblower nozzle which provides increased cleaning energy over a wide range of nozzle pressures.

Other objects, features and advantages of the present invention will become apparent from the following description when considered in conjunction with the accompanying drawings wherein like characters of reference designate corresponding parts throughout the several views.

DETAILED DESCRIPTION OF THE PREFERRED EMBODIMENTS

Figure 1:
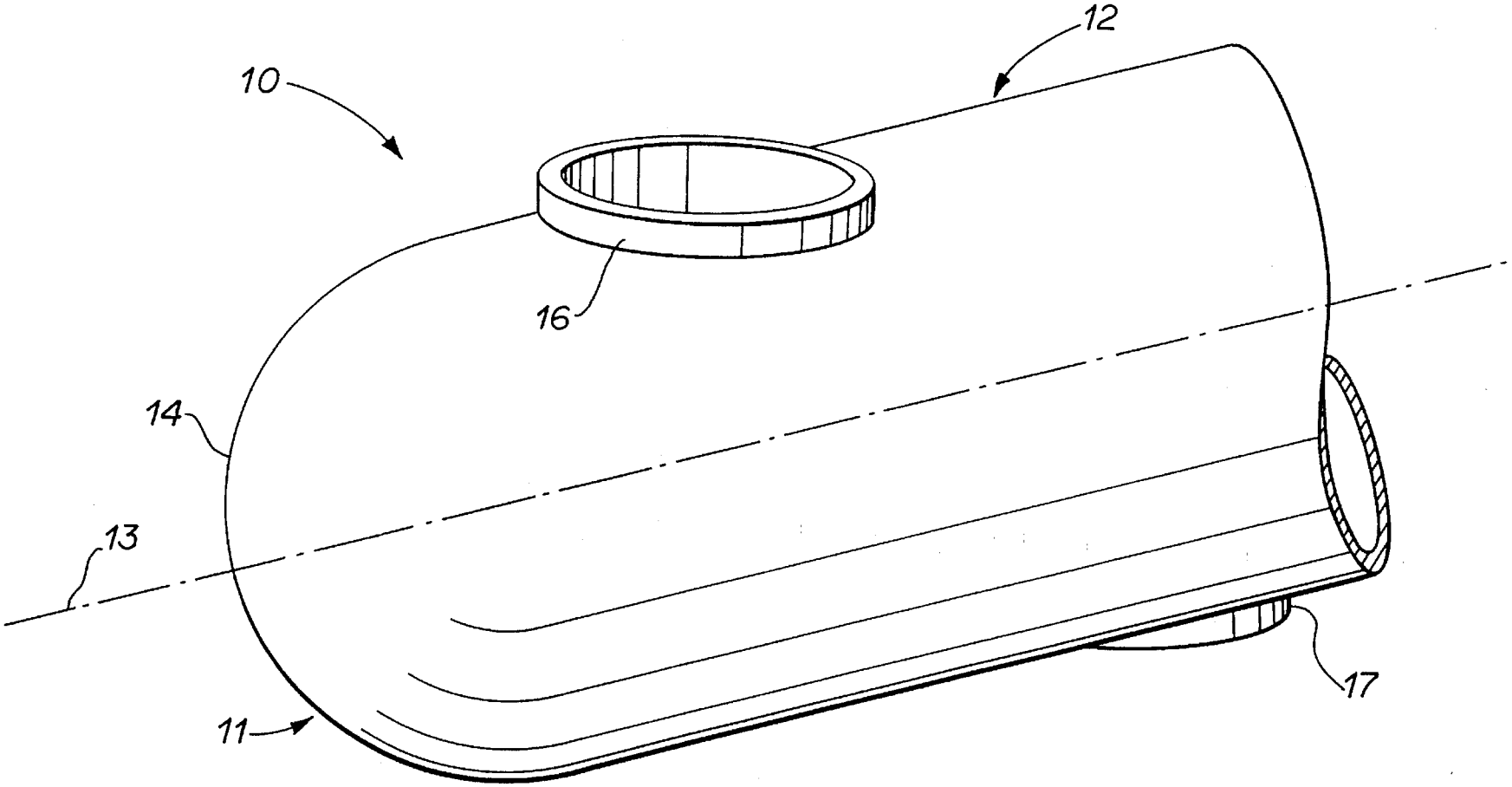
FIG. 1 is a fragmentary perspective view of a portion of a sootblower constructed in accordance with the present invention.

Referring now in more detail to the embodiments chosen for the purpose of illustrating the present invention, numeral 11 in FIG. 1 denotes the lance tube of a sootblower 10 of the present invention, the lance tube having a straight, hollowed tubular main body 12 which is inserted into a boiler, not shown, where it is rotated and/or oscillated about its longitudinal axis 13 for directing a compressible cleaning agent radially or sidewise of the main body 12 into the interior of a boiler. The main body 12 is closed at its distal end by a rounded, usually hemispherical outwardly protruding end 14.

The main body 12 is usually about 8 inches long with an outside diameter of approximately 3.5 inches, a wall thickness of approximately 0.25 inches and an inside diameter of about 3.0 inches. Body 12 is integrally joined to an otherwise conventional feeder tube, not shown, having an opposite end fixed to a motor driven carriage, not shown. The main body 12 is made of heat resistant material, such as stainless steel.

Mounted radially in the cylindrical main body 12 are axially spaced, substantially identical, nozzles 16 and 17 constructed in accordance with the present invention. The nozzles 16 and 17 are spaced from each other along the longitudinal axis 13 of body 12 and are circumferentially spaced about 180° from each other, so as to discharge simultaneously in opposite, offset radial directions.

Nozzles 16 and 17 are identical, each being a cylindrical shell machined from heat resistance rod material, such as stainless steel rods, and respectfully radially received in space, circumferentially disposed holes in body 12. The nozzles 16 and 17 are respectively fixed in place by welding, or alternatively, the lance tube and nozzles can be cast to form an integral piece.

Figure 2:
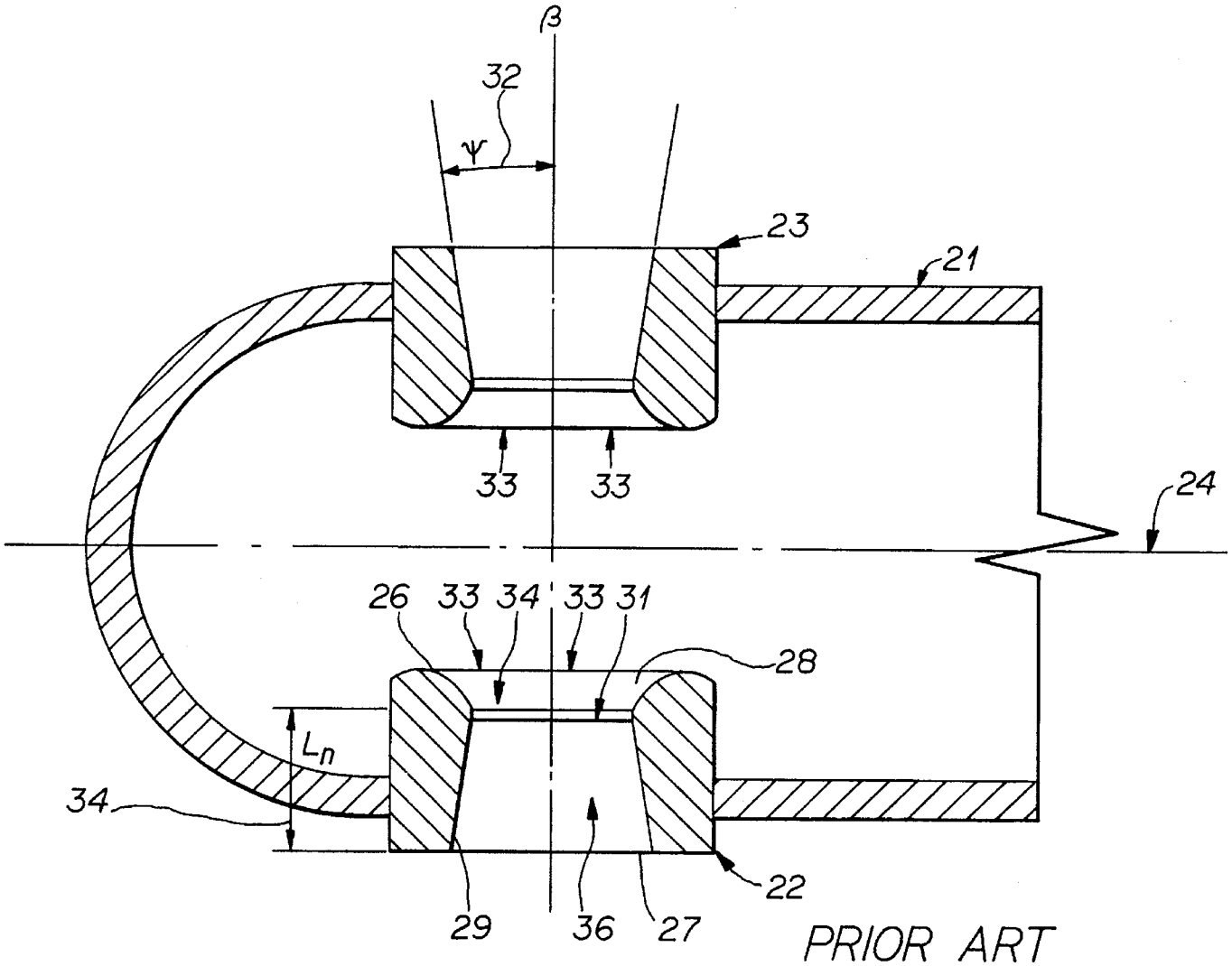
PRIOR ART FIG 2
FIG. 2 is a cross-sectional view of a conventional sootblower lance showing a conventional prior art nozzle.

To contrast the present invention I have shown, in FIG. 2, conventional prior art lance tube 21 typically incorporating de Laval nozzles 22, 23 aligned coaxially perpendicular to the longitudinal axis 24 of lance tube 21. The nozzles 22, 23 comprise an entrance end 26 and discharge end 27 connected by a passageway, defined by converging wall 28 and diverging wall 29. Converging wall 28 and diverging wall 29 merge at the most narrow point of the passageway for defining a throat 31. The diverging wall 29 of nozzles 22, 23 is defined by the divergence angle ψ denoted by numeral 32.

The compressible cleaning agent tinder pressure, such as steam, gas or vapor, passes through nozzles 22, 23 in the direction of arrows 33, entering entrance end 26 and thence through the converging section 34 defined by wall 28. At the throat 31, the cleaning agent reaches the local speed of sound. This speed is achieved by a reduction in the cleaning agent pressure. Beyond the throat area 31, the cleaning agent is further accelerated to speeds exceeding the speed of sound. The cleaning agent then passes into the expansion chamber 36 defined by wall 29 where the cleaning agent progressively expands, resulting in a corresponding drop in pressure throughout the length 34 of expansion chamber 36. Thence, the cleaning agent exits the nozzle from the discharge end 27 of nozzles 22, 23.

The amount of expansion of the gas passing through a conventional nozzle 22, or 23 is controlled by the nozzle geometry. The expansion of a fluid in expansion chamber 36 is given by:

$$\frac{P_o}{P_e} = \left(1 + \frac{\gamma - 1}{2} M_e^2\right)^{\frac{\gamma}{\gamma - 1}} \tag{1}$$

where $P_0$=lance pressure, $P_e$=exit pressure, $M_e$=Mach number at the exit, and $\gamma = C_p/C_v$ for the cleaning agent.

If it is desired to reach atmospheric pressure $P_\infty$ at the nozzle exit so as to have full expansion, then the exit Mach number (the ratio of gas velocity to local speed of sound) $M_e$ is given by equation (1). By the conservation of mass, the ratio of exit area $A_e$ to throat area $A_t$ can be expressed in terms of the exit Mach number $M_e$ given by:

$$\frac{A_e}{A_T} = \left(\frac{d_e}{d_T}\right)^2 = \frac{1}{M_e}\left[\left(\frac{2}{\gamma+1}\right)\left(1 + \frac{\gamma - 1}{2} M_e^2\right)\right]^{\frac{\gamma+1}{2(\gamma-1)}} \tag{2}$$

Knowing $M_e$ from equation (1) and given the throat diameter $d_T$ by the required mass flow, the exit diameter $d_e$ can be derived from equation (2). Furthermore, for a conical nozzle the following relation holds true:

$$\frac{d_e - d_T}{2L_n} = \tan\left(\frac{\psi}{2}\right) \tag{3}$$

where ψ=divergence angle and $L_n$=length of expansion chamber.

Thus, the expansion chamber length $L_n$ for a full expansion nozzle can be calculated as done in Table 1, column 5.

Limited by the inside diameter of conventional lance tube 21 and the opening in the boiler wall, the length, $L_n$, 34 of the expansion chamber 36 of nozzles 23, is limited, such that the cleaning agent passing through nozzles 23 typically expands sufficiently for the pressure of the exiting cleaning agent to be typically about 4 times that of the ambient pressure. Consequently, the discharging cleaning agent is "under expanded," resulting in an uncontrolled expansion of this cleaning agent outside the nozzle and a reduction in the available cleaning energy in the exiting jet. Therefore, it is desirable to have a nozzle capable of allowing the cleaning agent passing through it to expand sufficiently, prior to its discharge, so that the pressure of the exiting cleaning agent jet is substantially equal to the ambient pressure.

Unconditionally, increasing the divergence angle ψ of nozzles 22, 23 is not a viable solution for achieving greater expansion within the available space, because there is a resulting boundary layer separation, as mentioned previously.

Figure 3B:
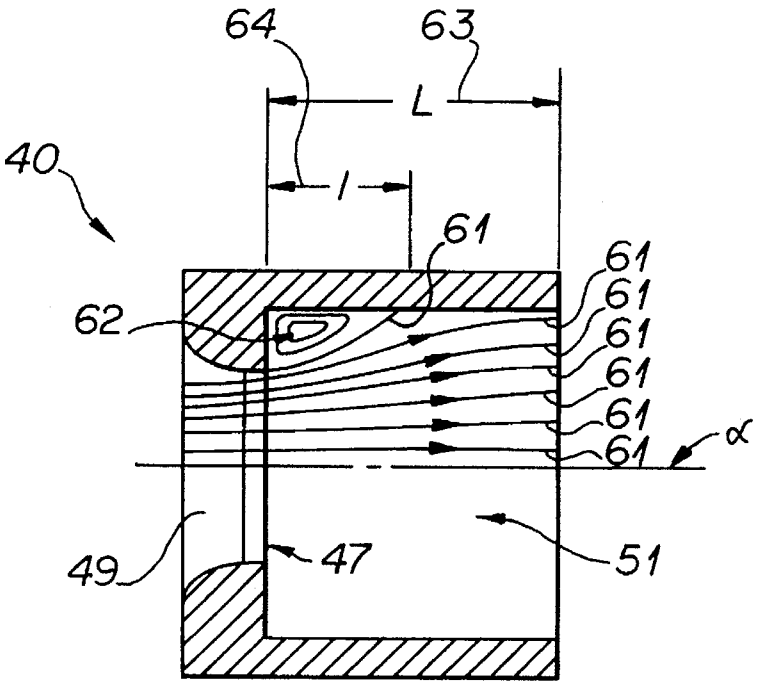
FIG. 3B is an enlarged cross-sectional view similar to FIG. 3A and showing the flow lines therein, depicting the fluid flow in the nozzle.
Figure 3A:
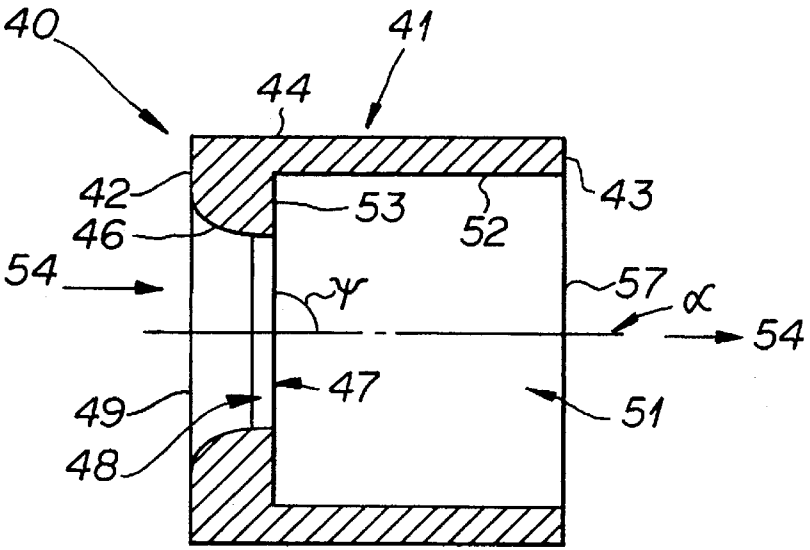
FIG. 3A is an enlarged cross-sectional view of a nozzle of the sootblower shown in FIG. 1.

In accordance to the present invention, a first embodiment referred to as a rapid expansion nozzle is depicted in FIGS. 3A and 3B. Rapid expansion nozzle 40 has a cylindrical body, denoted generally by numeral 41, body 41 having a central longitudinal axis α, a radially disposed front upstream surface 42 and a radially disposed rear down stream surface 43. Body 41 is symmetrical about axis α, having an outer surface 44 of uniform diameter throughout its length and a hollow interior passageway. The hollow interior includes a fluid intake zone defined by a circular converging surface wall 46 from the upstream surface 42 inwardly to a circular throat or mouth 47. The throat 47 forms a restricted area through which the cleaning agent passes. In cross-section the converging surface or wall 46 is convex, and tapers in a downstream direction to merge parallel to the nozzle axis a at section 48 of throat 47. Thus, the converging surface defines an entrance 49 through which the cleaning agent passes.

The nozzle body 41 is counter bored from the down stream surface inwardly for providing an intermediate rapid expansion chamber or portion 51, defined by a circular inner expansion surface or wall 52 which is of uniform diameter essentially throughout its length and is concentric with outer wall 44, about axis α.

Also produced by the counterboring is a radially disposed, flat reaction wall 53 surrounding the discharge end of throat 47. In cross-section the reaction wall 53 is perpendicular to the axis α of inner wall 52. Hence, as seen in FIG. 3A and 3B, reaction wall 53 forms a divergence angle ψ of 90°.

In operation, a cleaning agent enters nozzle 41 in the direction indicated by arrows 54 through opening 49 into a converging chamber defined by wall 46 and thence into throat 47. As with the prior art nozzles, the cleaning agent reaches a speed of sound at the throat 47. Having passed through throat 47, the cleaning agent is discharged into the central portion of the upstream end of the expansion chamber or passage 51 where it expands and decreases in pressure. Subsequently exiting the nozzle 40 at discharge end 57.

Referring to FIG. 3B, the typical stream lines for the flow field of the cleaning agent passing through nozzle 40 are illustrated by lines 61. As a flow field is initially established, a recirculating toroidal bubble 62 is formed in the junction of walls 53 and 52. As a result, the recirculating toroidal bubble 62 acts a solid body such that the cleaning agent within the flow field slides by the recirculating toroidal bubble 62 as it passes from throat 47 through expansion chamber 51. Consequently, the cleaning agent rapidly expands in the portion of expansion chamber 51 adjacent to throat 47 earlier than the expansion achieved in conventional nozzles. Therefore, the cleaning agent jet discharged from nozzle 40 is substantially fully expanded so as to maximize the cleaning energy (PIP) in the jet. In order to achieve this effect, the length 63 of expansion chamber 51 must be greater than the length 64 of the recirculating toroidal bubble 62. In conventional operation, length 63 of the divergent segment is approximately 1.30 to 1.50 inches, 1.46 inches ideally. See Table II below. In addition of the fact that this nozzle provides rapid expansion, it also provides a gas stream exiting nozzle 40 that is traveling parallel to the nozzle's axis α.

TABLE II

SELECTED GEOMETRICAL PROPERTIES FOR RAP-FE & C-FE NOZZLE; USING AIR. ATMOSPHERIC PRESSURE $P_\infty$ = 14.7 PSIG, AIR TEMPERATURE 68 F. AND $d_T$ = 1"

| RAPID EXPANSION NOZZLE | CONTOUR NOZZLE | | PRIOR ART FEN | | | |
|---|---|---|---|---|---|---|
| $L_D$(in) | $L_{D1}$(in) | $L_{D2}$(in) | $L_D$(in) | $P_o$(psig) | $d_e$(in) | Q (SCFM) |
| 1.46 | 3.47 | 1.78 | 2.62 | 200 | 1.55 | 2916 |
| 1.46 | 3.86 | 1.94 | 3.09 | 250 | 1.65 | 3594 |
| 1.46 | 4.22 | 2.08 | 3.52 | 300 | 1.74 | 4273 |

Figure 4A:
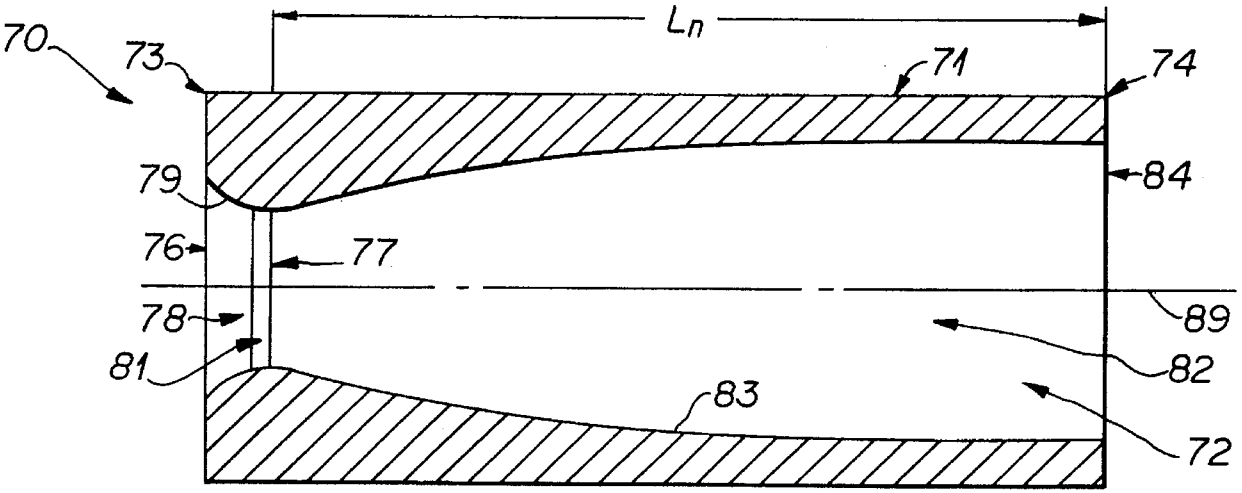
FIG. 4A is an enlarged cross-sectional view of a second embodiment of the sootblower nozzle of the present invention.
Figure 4C:
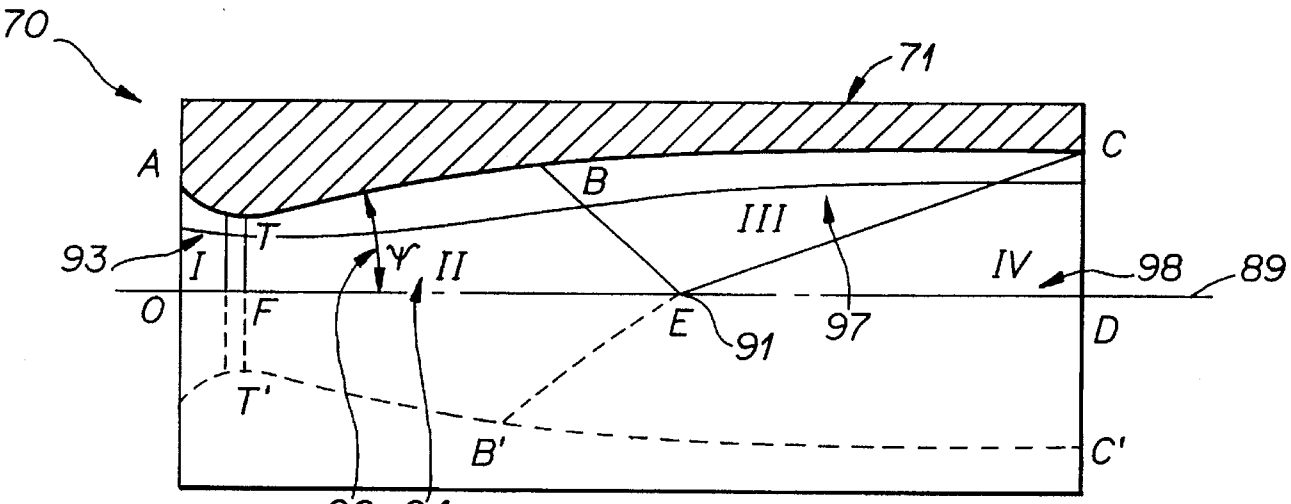
FIG. 4C is a view similar to FIG. 4A and showing the flow regions of the nozzle.
Figure 4B:
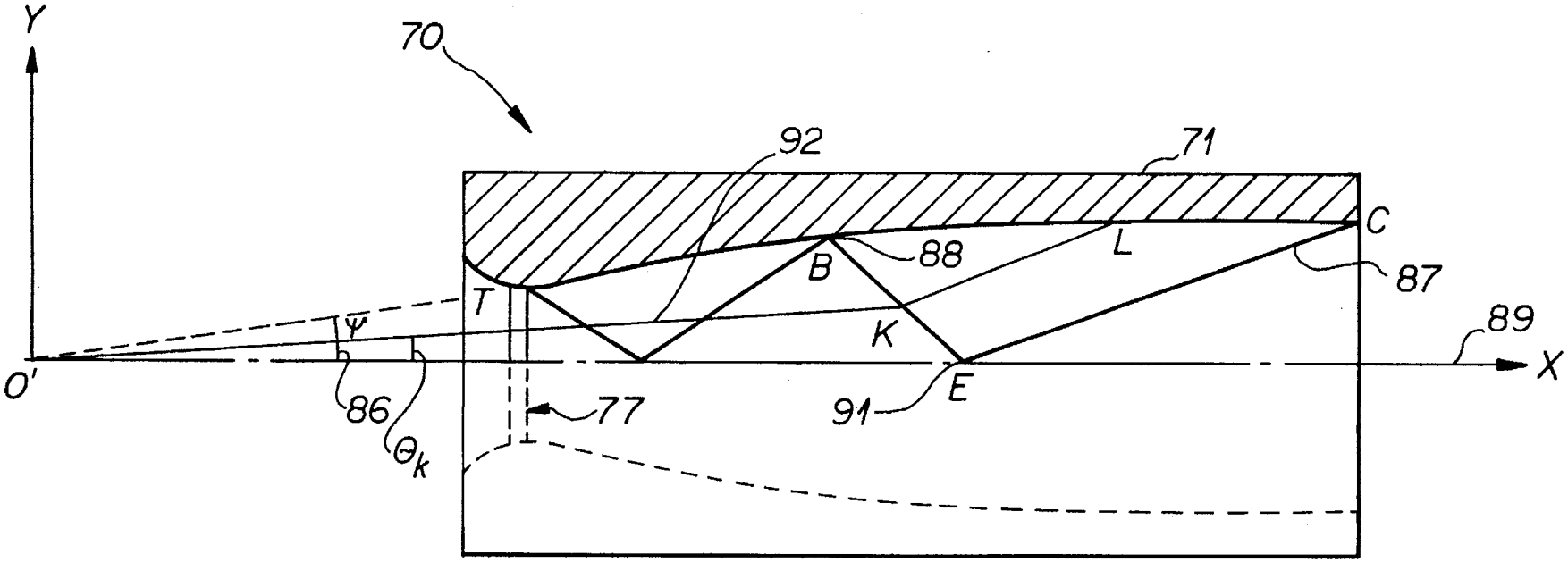
FIG. 4B is a view similar to FIG. 4A and illustrating the flow of wave KL through the nozzle.

$P_o$ - Blowing pressure
$L_D$ - Nozzle length, divergent section
$L_{D1}$ - Length divergent section, C-FE nozzle
$L_{D2}$ - Length divergent section, C-FE nozzle truncated
$d_e$ - Nozzle exit diameter
$d_T$ - Nozzle throat diameter
Q - Volume flow rate
FEN - Full Expansion Nozzle A second embodiment of the present invention, contour nozzle 70, is illustrated in FIGS. 4A, 4B and 4C. Contoured rapid expansion nozzle 70 comprises a body 71 having a passageway 72 extending between an entrance end 73 and discharge end 74. An opening 76 in entrance end 73 is in communication with a throat 77 via convergent zone 78 defined by inner surface 79. The throat area 81 forms a restricted area and is selected so that the mass flow of nozzle 70 is equivalent to that of conventional nozzles. Spanning between throat 77 and discharge end 74 is expansion chamber 82 defined by inner expansion surface 83. Disposed at discharge end 74 is opening 84.

In operation, a cleaning agent enters nozzle 70 through opening 76 into convergent zone 78 defined by wall 79 terminating at throat 77. The cleaning agent then passes through throat 77 into expansion chamber 82 defined by inner expansion surface 83 which extends from throat 77 to discharge end 74. The cleaning agent exits nozzle 70 at its discharge end 74. The early expansion of cleaning agent in expansion chamber 82 of nozzle 70 is best explained by briefly stating the applicable theories of flow field then defining and analyzing four flow regions for half of the nozzle's passageway where a mirror image of this flow is found below the nozzle axis 89.

The theory upon which the present invention operates is that, upon passing the throat 77 the gas exceeds the speed of sound and is supersonic. The flow through nozzle 70 is modeled as if it is emerging from a fictitious point source 0' as shown in FIG. 4B. Due to the change in angle ψ, denoted by numeral 86 and defining the wall TB, an expansion wave is set up as shown by the heavy line 87 in FIG. 4B. The nozzle is chosen such that only a single reflection of this wave is permitted as indicated by point B, denoted by numeral 88. Also, the nozzle is chosen such that at the point of intersection of this reflected wave 87 and the axis 89 of the nozzle, shown here by point E which is denoted by numeral 91, is the point where full expansion occurs. The curvilinear wall BC, in redirecting the flow to emerge parallel to the axis 89, prevents any appreciable reflection of these waves on the nozzle wall. At discharge end 74 inner expansion surface 83 is essentially cylindrical.

For purposes of explaining the relevant physics involved in this flow, consider one such wave KL, denoted by numeral 92, emerging across BE. By solving for the flow along KL as shown below, it is possible to trace the transient curve wall BC of nozzle 70.

For full expansion from a lance pressure $P_o$ to a nozzle exit pressure $P_c$, the nozzle exit Mach number $M_e$ is:

$$\frac{P_o}{P_e} = \left(1 + \frac{\gamma - 1}{2} M_e^2\right)^{\frac{\gamma}{\gamma - 1}} \quad (4)$$

where $\gamma = C_p/C_v$ for the cleaning fluid.

Based on the exit Mach number $M_e$ from equation (4), the exit diameter $d_e$ of the nozzle based on a known throat diameter $d_T$ can be determined by:

$$\left(\frac{d_e}{d_T}\right)^2 = \frac{A_e}{A_T} = \frac{1}{M_e} = \left[\left(\frac{2}{\gamma+1}\right)\left(1+\frac{\gamma-1}{2}M_e^2\right)\right]^{\frac{\gamma+1}{2(\gamma-1)}} \quad (5)$$

where $A_e$=exit area and $A_T$=throat area.

The expansion angle ω is the angle made between successive positions of polar vector $r\angle\theta_K$ along line BE, where r is the radial distance from point O' to point K. From the sonic throat (ω=0 for M=1) to an arbitrary Mach number M, expansion angle ω is:

$$\omega = \frac{1}{2}\left[\sqrt{\frac{\gamma+1}{\gamma-1}}\tan^{-1}\sqrt{\frac{\gamma-1}{\gamma+1}(M^2-1)} - \tan^{-1}\sqrt{M^2-1}\right] \quad (6)$$

The slope of the wall TB is given by:

$$\psi = \theta_B = \frac{\omega_e}{2} \quad (7)$$

where $\omega_e$ is computed from equation (6) with $M=M_e$.

At any location K along the expansion wave BE, the corresponding angle would be $\omega_K=f(M_K)$ and the angular coordinate of K is given by:

$$\theta_K=\omega_E-\omega_K \quad (8)$$

By varying $M_B<M_K<M_E$, it is possible to trace the expansion along BE. In so doing, the curve defining curvilinear wall BC is obtained. This is done by solving the characteristic equations along the wave KL, leading to the coordinate of any point along BC, such as point L in FIG. 4B, is given by:

$$X_L = \frac{d_e}{4\mathrm{Sin}(\psi/2)}\left(\frac{\lambda_K}{\lambda_e}\right)\frac{1+F(\theta_K)(\cos\theta_k\sqrt{M_k^2-1}-\mathrm{Sin}\theta_k)}{\mathrm{Sin}\theta_k\sqrt{M_k^2-1}+\cos\theta_k} \quad (9)$$

and $$Y_L = \frac{d_e}{4\mathrm{Sin}(\psi/2)}\left(\frac{\lambda_k}{\lambda_e}\right)F(\theta_k) \quad (10)$$

where $$F^2(\theta_k) = \sin^2\theta_k + 2(\cos\theta_k - \cos\psi)(\sqrt{M_k^2-1}\ \mathrm{Sin}\theta_k - \cos\theta_k) \quad (11)$$

and $$\lambda^2 = \frac{1}{M}\left[\frac{2}{\gamma+1}+\frac{\gamma-1}{\gamma+1}M^2\right]^{\frac{\gamma+1}{2(\gamma-1)}} \quad (12)$$

The underlying assumption thus far has been that the described flow is point source flow from origin O'. The dimension $X_L$ in equation (9) represents a length based upon this origin. However, the actual flow in the real nozzle is planar and uniformially distributed at the throat 77 in FIG. 4B. Hence, the axial distances have to be adjusted by subtracting the length O'F from value $X_L$ calculated using equation (9). The length O'F is given by:

$$O'F = \frac{d_e}{2\lambda_e}\left[\mathrm{Cot}\psi - \frac{\lambda_B\cos(\psi/2)-1}{2\mathrm{Cos}(\psi/2)[\mathrm{Sin}(\psi/2)+\mathrm{Cos}(\psi/2)]}\right] \quad (13)$$

Equations (4) through (13) provide the essence of the design procedure for this nozzle where sonic flow at the throat is expanded radially along wall TB and made parallel by wall BC.

Referring to FIG. 4C and the division of nozzle 49 into flow regions, the interior channel of nozzle 70 is defined by passageway ACDO and is symmetrical about axis 89. Inlet region I, denoted by numeral 93 and defined by ATFO, is similar to that found in conventional nozzles. In region II, denoted by numeral 94 and defined by TBEF, the cleaning agent expands through the conical section defined by wall TB. Within region II, wall TB is defined by divergence angle ω denoted by numeral 96. Prior to exiting region II, the cleaning agent substantially fully expands, though the cleaning agent emerging from region II is no longer traveling parallel to the nozzle axis 89.

In region III, denoted by numeral 97 and defined by BCE, the velocity vectors of the cleaning agent are redirected parallel with axis 89 such that the cleaning agent emerging from zone IV exiting nozzle 70 is a substantially fully expanded and flowing parallel to axis In region IV, denoted by numeral 98 and defined by ECD, essentially no change occurs in the cleaning agent jet.

As shown in Table II above, the length $L_n$ of the expansion chamber 82 of contour nozzle 70 is too great to be mounted in a conventional lance tube. However, contour nozzle 70 can be truncated at approximately point E, denoted by numeral 91 in FIG. 4B, without noticing any appreciable decrease of performance in the nozzle 70. The location of point E with respect to the origin O' is given by:

$$O'E = \frac{d_e}{4\mathrm{Sin}\left(\frac{\psi}{2}\right)} \quad (14)$$

As with the distances calculated in equation (9), this distance must be reduced by the length O'F from equation (13) to account for the planar flow in the nozzle throat.

Truncating nozzle 70 past point E starts to reduce the nozzle's ability to produce a high valve for PIP. Minimum loss occurs in truncating nozzle 70 because the cleaning agent passing through expansion chamber 82 is fully expanded at point E and no thermodynamic change in the fluid occurs in region IV. What is gained is a full expansion nozzle capable of being mounted in a conventional lance tube and having the mass flow of conventional nozzles.

Figure 5:
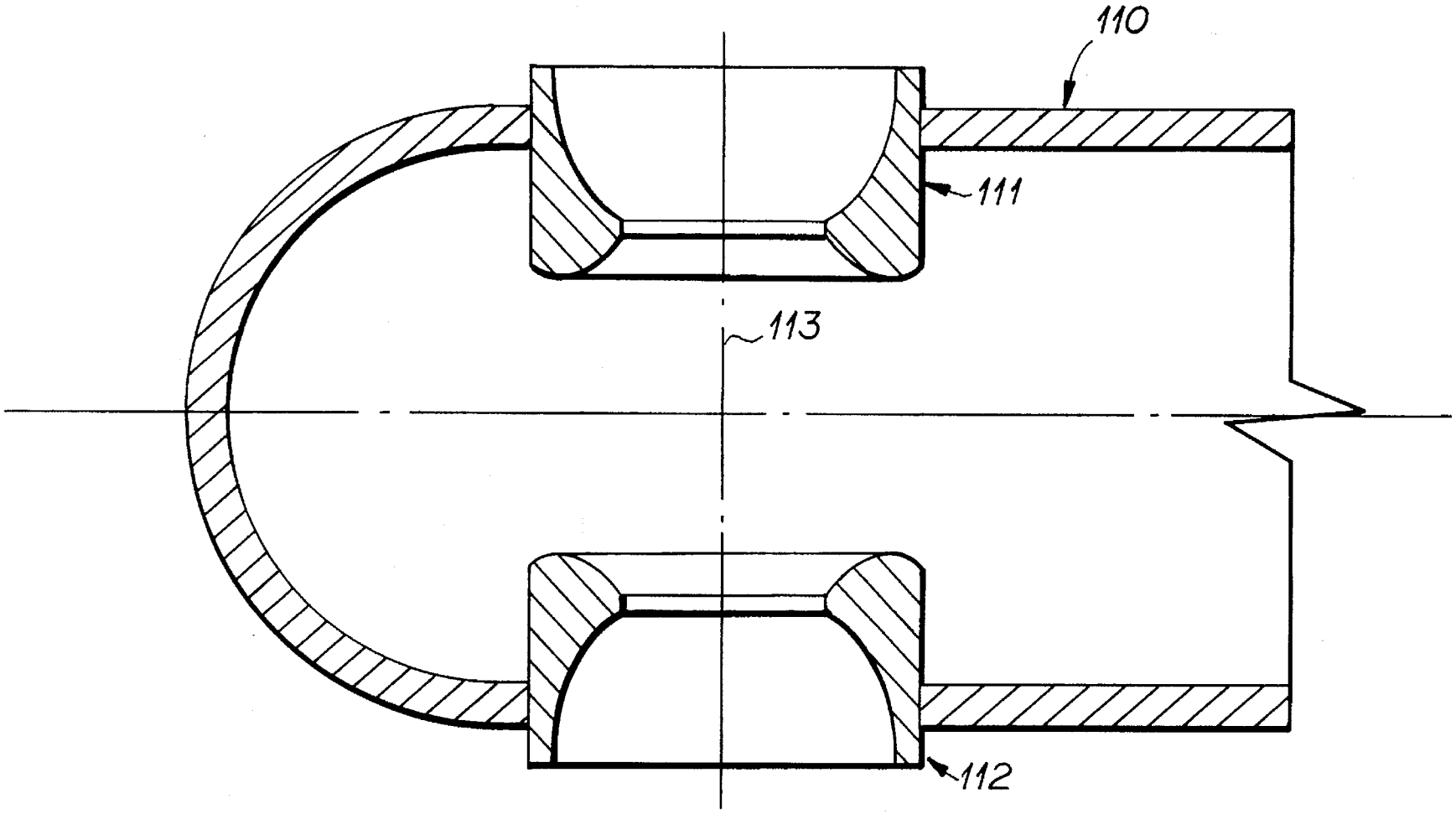
FIG. 5 is a vertical sectional view of a sootblower shown in FIG. 1.

An alternative mounting configuration to that shown in FIG. 1 is illustrated in FIG. 5. Lance tube 110 includes a pair of nozzles 111, 112 in diametrically opposite relation positioned coaxially along axis 113. The nozzles 111, 112 are constructed in accordance with rapid expansion nozzles disclosed as the first embodiment of the present invention through the contour nozzle disclosed as the second embodiment can also be mounted similarly.

Figure 6:
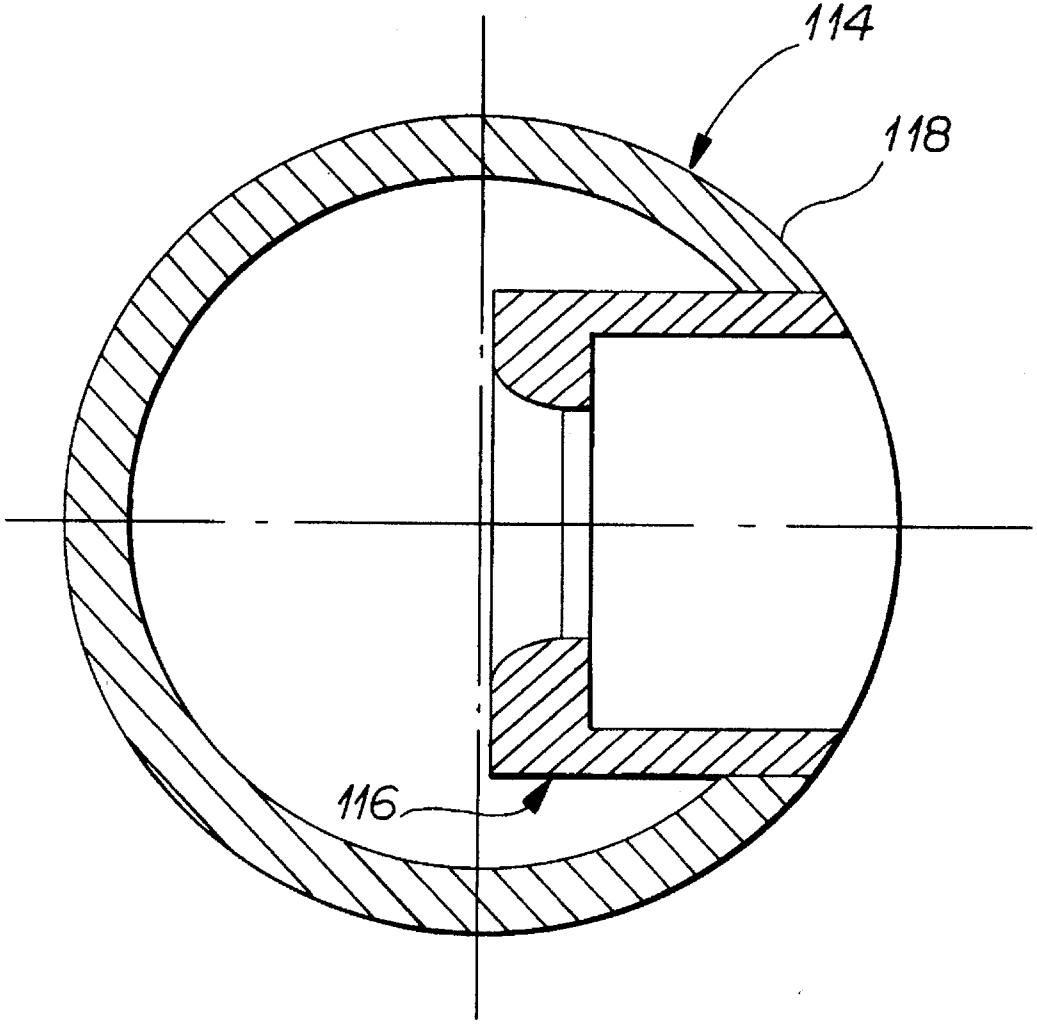
FIG. 6 is a cross-sectional end view of a portion of a sootblower showing the profile of a nozzle constructed in accordance with the present invention mounted flush with the outer surface of the lance of the sootblower.

In reference to FIG. 6*a*, nozzle 116 mounted to lance tube 114 and constructed in accordance with the present invention, may be mounted flush and contoured to the arcuate outer surface 118 of lance tube 114 so that the lance tube 114 may be inserted into a boiler, not shown, with greater clearance. As seen with reference to FIG. 6, nozzle 116 is in direct communication with the interior of lance tube 114 without any obstruction to the flow of a cleaning agent passing from lance tube 114 into nozzle 116.

I claim:

1. A sootblower of the type having an elongated hollow lance tube having a longitudinal axis and insertable into a boiler for supplying a cleaning agent under pressure to the interior of the boiler, the improvement comprising:

a one piece nozzle mounted through one side of said lance tube for directing said cleaning agent in a sidewise direction from said lance tube;

said nozzle having a passageway through its central portion and through which said cleaning agent passes from said lance tube, said passageway having a central axis, an upstream entrance end having unobstructed communication with the interior of said lance tube and a downstream discharge end for directing said fluid exteriorly of said lance tube;

said nozzle having a converging inner surface adjacent to said entrance end and a throat intermediate the ends of said passageway, said inner surface converging toward said throat;

said nozzle having an expansion chamber downstream from said throat, said expansion chamber including a reaction wall having a first slope and an inner expansion wall having a second slope, wherein said first slope is greater than said second slope;

said expansion chamber being adapted to permit said cleaning agent to expand rapidly immediately after passing through said throat in a controlled expanded condition such that the static pressure of the cleaning agent discharged from the discharge end of said nozzle is less than or equal to twice the ambient pressure surrounding said lance tube.

2. The sootblower defined in claim 1 wherein said reaction wall increment forms a divergence angle of between about 10° to about 90° with respect to said central axis.

3. The sootblower defined in claim 2 wherein said inner expansion wall comprise a section adjacent said reaction wall that is curvilinear and concave in cross-section.

4. The sootblower defined in claim 3 wherein said inner expansion wall comprises a section adjacent said discharge end that is of substantially uniform diameter for an area in an axial direction.

5. The sootblower defined in claim 2 wherein said inner expansion wall is of uniform diameter throughout its length.

6. The sootblower defined in claim 1 wherein the portion of said expansion chamber adjacent said discharge end is designed so as to form a columnar jet exiting said discharge end of said nozzle.

7. The sootblower defined in claim 1 including an additional nozzle similar to said nozzle and wherein said nozzle and said additional nozzle form opposed nozzles extending coaxially through opposing walls of said lance tube so that said fluid is discharged simultaneously through said nozzle in opposite directions.

8. The sootblower defined in claim 1 including an additional nozzle similar to said nozzle for forming a pair of nozzles and wherein said pair of nozzles are spaced apart along said central axis of said lance tube and are circumferentially disposed about 180° apart so as to discharge sidewise of said lance tube in opposite directions.

9. The sootblower defined in claim 1 having a lance tube with an arcuate outer surface and wherein said discharge end of said nozzle is flush with said arcuate outer surface of said lance tube.

10. The sootblower defined in claim 1 wherein said portion of said nozzle which defines said inner expansion wall is of uniform diameter throughout its entire length.

11. The sootblower defined in claim 1 wherein the length of said expansion chamber is sufficient for said fluid to be fully expanded as it emerges from said discharge end.

12. The sootblower defined in claim 1 wherein said inner expansion surface is conical adjacent to said throat and has an area of substantially uniform diameter adjacent to its discharge end.

13. The sootblower defined in claim 1 wherein said expansion chamber includes an essentially flat radial surface adjacent to said throat and essentially axially disposed circular surface of uniform diameter throughout the remainder of said inner expansion surface.

14. A process for directing a compressible cleaning agent against a an interior surface of a boiler comprising the steps of:

directing said compressible cleaning agent under pressure along a confined path in a downstream direction;

passing said agent sidewise of said confined path progressively through a restricted area so as to impart increased velocity to said agent as it emerges from said restricted area and approaches a sonic speed;

rapidly expanding said agent after it passes from said restricted area into an expansion zone comprising a reaction wall having a slope greater than 10° with respect to a central axis of said path, so as accelerate the expanding agent so that it progressively approaches ambient pressure and a velocity in excess of the said sonic speed, and an inner expansion wall that subsequently redirects said agent in a direction substantially parallel to said path into ambient air and towards said surface at a velocity in excess of said sonic speed after it has been expanded, into a columnar flow; and progressively forming said agent into a column while directing said agent out of its confined path and into ambient air and toward said surface.

15. The process defined in claim 14 wherein the step of rapidly expanding said cleaning agent includes fully expanding said cleaning agent prior to exiting.

16. A process for directing and expanding a compressible cleaning agent passing through a one piece sootblower nozzle, comprising the steps of:

providing a cleaning agent under pressure;

directing and accelerating said cleaning agent to a sonic speed as said cleaning agent passes through a restricted area;

rapidly expanding and accelerating said cleaning agent exiting the restricted area in a first part of an expansion zone adjacent and downstream of the restricted area and defined by reaction wall having a first slope greater than 10° with respect to the center axis of the nozzle;

directing said cleaning agent in a direction parallel with the center axis of the nozzle in a second part of the expansion zone defined by an inner expansion wall having a second slope less than said first slope; and producing a columnar jet.

17. The process defined in claim 16 wherein the step of rapidly expanding said cleaning agent includes fully expanding said cleaning agent prior to exiting.

18. The sootblower defined in claim 1 wherein said passageway is open and generally circular in shape.

19. The sootblower defined in claim 1 wherein said expansion chamber is less than 3.0 inches in length.

20. A sootblower of the type having an elongated hollow lance tube having a longitudinal axis and insertable into a boiler for supplying a cleaning agent under pressure to the interior of the boiler, the improvement comprising:

a nozzle mounted through one side of said lance tube for directing said cleaning agent in a sidewise direction from said lance tube;

said nozzle having a passageway through its central portion and through which said cleaning agent passes from said lance tube, said passageway having a central axis, an upstream entrance end in communication with the interior of said lance tube and a downstream discharge end for directing said fluid exteriorly of said lance tube;

said nozzle having a converging inner surface adjacent to said entrance end and a throat intermediate the ends of said passageway, said inner surface converging toward said throat;

said nozzle having an expansion chamber downstream from said throat, said expansion chamber having a reaction wall and an inner expansion wall;

said expansion chamber being adapted to permit said cleaning agent to expand rapidly immediately after passing through said throat in a controlled expanded condition such that the static pressure of the cleaning agent discharged from the discharge end of said nozzle is less than or equal to twice the ambient pressure surrounding said lance tube; and wherein the portion of said expansion chamber adjacent said discharge end is designed so as to form a columnar jet exiting said discharge end of said nozzle.

21. The sootblower defined in claim 20 wherein said reaction wall forms a divergence angle of between about 10° to about 90° with respect to said central axis.

22. The sootblower defined in claim 20 wherein said inner expansion wall comprise a section adjacent said reaction wall that is curvilinear and concave in cross-section.

23. The sootblower defined in claim 20 wherein said inner expansion wall comprises a section adjacent said discharge end that is substantially uniform in diameter for an area in the axial direction.

24. The sootblower defined in claim 20 wherein said expansion chamber is less than 3.0 inches in length.

25. The sootblower defined in claim 20 wherein said reaction wall has a first slope and said inner expansion wall has a second slope, wherein said first slope is greater than said second slope.

26. The sootblower defined in claim 20 wherein said inner expansion wall is of uniform diameter throughout its length.

27. A sootblower of the type having an elongated hollow lance tube having a longitudinal axis and insertable into a boiler for supplying a cleaning agent under pressure to the interior of the boiler, the improvement comprising:

a nozzle mounted through one side of said lance tube for directing said cleaning agent in a sidewise direction from said lance tube;

said nozzle having a passageway through its central portion and through which said cleaning agent passes from said lance tube, said passageway having a central axis, an upstream entrance end in communication with the interior of said lance tube and a downstream discharge end for directing said fluid exteriorly of said lance tube;

said nozzle having a converging inner surface adjacent to said entrance end and a throat intermediate the ends of said passageway, said inner surface converging toward said throat;

said nozzle having an expansion chamber downstream from said throat, said expansion chamber having a reaction wall and an inner expansion wall;

said expansion chamber being adapted to permit said cleaning agent to expand rapidly immediately after passing through said throat in a controlled expanded condition such that the static pressure of the cleaning agent discharged from the discharge end of said nozzle is less than or equal to twice the ambient pressure surrounding said lance tube; and an additional nozzle similar to said nozzle for forming a pair of nozzles and wherein said pair of nozzles are spaced apart along said central axis of said lance tube and are circumferentially disposed about 180° apart so as to discharge sidewise of said lance tube in opposite directions.

28. The sootblower defined in claim 27 wherein said reaction wall forms a divergence angle of between about 10° to about 90° with respect to said central axis.

29. The sootblower defined in claim 27 wherein said inner expansion wall comprise a section adjacent said reaction wall that is curvilinear and concave in cross-section.

30. The sootblower defined in claim 27 wherein said inner expansion wall comprises a section adjacent said discharge end that is substantially uniform in diameter for an area in the axial direction.

31. The sootblower defined in claim 27 wherein said expansion chamber is less than 3.0 inches in length.

32. The sootblower defined in claim 27 wherein said reaction wall has a first slope and said inner expansion wall has a second slope, wherein said first slope is greater than said second slope.

33. The sootblower defined in claim 27 wherein said inner expansion wall is of uniform diameter throughout its length.

34. A sootblower of the type having an elongated hollow lance tube having a longitudinal axis and insertable into a boiler for supplying a cleaning agent under pressure to the interior of the boiler, the improvement comprising:

a nozzle mounted through one side of said lance tube for directing said cleaning agent in a sidewise direction from said lance tube;

said nozzle having a passageway through its central portion and through which said cleaning agent passes from said lance tube, said passageway having a central axis, an upstream entrance end in communication with the interior of said lance tube and a downstream discharge end for directing said fluid exteriorly of said lance tube;

said nozzle having a converging inner surface adjacent to said entrance end and a throat intermediate the ends of said passageway, said inner surface converging toward said throat;

said nozzle having an expansion chamber downstream from said throat, said expansion chamber having a reaction wall and an inner expansion wall;

said expansion chamber being adapted to permit said cleaning agent to expand rapidly immediately after passing through said throat in a controlled expanded condition such that the static pressure of the cleaning agent discharged from the discharge end of said nozzle is less than or equal to twice the ambient pressure surrounding said lance tube; and a lance tube with an arcuate outer surface and wherein said discharge end of said nozzle is flush with said arcuate outer surface of said lance tube.

35. A sootblower of the type having an elongated hollow lance tube having a longitudinal axis and insertable into a boiler for supplying a cleaning agent under pressure to the interior of the boiler, the improvement comprising:

a nozzle mounted through one side of said lance tube for directing said cleaning agent in a sidewise direction from said lance tube;

said nozzle having a passageway through its central portion and through which said cleaning agent passes from said lance tube, said passageway having a central axis, an upstream entrance end in communication with the interior of said lance tube and a downstream discharge end for directing said fluid exteriorly of said lance tube;

said nozzle having a converging inner surface adjacent to said entrance end and a throat intermediate the ends of said passageway, said inner surface converging toward said throat;

said nozzle having an expansion chamber downstream from said throat, said expansion chamber having a reaction wall and an inner expansion wall;

said expansion chamber being adapted to permit said cleaning agent to expand rapidly immediately after passing through said throat in a controlled expanded condition such that the static pressure of the cleaning agent discharged from the discharge end of said nozzle is less than or equal to twice the ambient pressure surrounding said lance tube; and wherein said expansion chamber includes an essentially flat radial surface adjacent to said throat and essentially axially disposed circular surface of uniform diameter throughout the remainder of said inner expansion wall.

* * * * *

US005505163B1

REEXAMINATION CERTIFICATE (3805th)

United States Patent [19] [11] B1 5,505,163

Jameel [45] Certificate Issued Jul. 6, 1999

[54] SOOTBLOWER NOZZLE

[75] Inventor: Mohomed I. Jameel, Tucker, Ga.

[73] Assignee: Bergemann USA, Inc., Atlanta, Ga.

Reexamination Request:
No. 90/004,419, Oct. 21, 1996

Reexamination Certificate for:

| | |
|---|---|
| Patent No.: | **5,505,163** |
| Issued: | **Apr. 9, 1996** |
| Appl. No.: | **08/210,321** |
| Filed: | **Mar. 18, 1994** |

[51] Int. Cl.[6] ..... F22B 37/18

[52] U.S. Cl. ..... 122/379; 122/390; 122/392; 122/405

[58] Field of Search ..... 122/379, 390, 122/392, 405

[56] References Cited

U.S. PATENT DOCUMENTS

| | | |
|---|---|---|
| 330,443 | 11/1885 | Vanduzen . |
| 5,230,306 | 7/1993 | Barringer et al. . |
| 5,271,356 | 12/1993 | Kling et al. . |
| 5,375,771 | 12/1994 | Jameel et al. . |

OTHER PUBLICATIONS

Applicant: Cold Jet, Inc., Noise Attenuating Supersonic Nozzle, Aug. 23, 1990, International Publication No. WO 90/09243.

M.I. Jameel, et al., Initial Expansion Region of an Underexpanded Nozzle, undated, pp. 1–33.

M.I. Jameel, et al., Hydrodynamic Behaviour of Pressurized Steam Flowing through a Sootblower Nozzle—A Fundamental Analysis, 1992.

M.I. Jameel, et al., Sootblower Optimization—Part 1 Fundamental Hydrodynamics of a Sootblower Nozzle and Jet, 1993.

A.H. Shapiro, The Dynamics and Thermodynamics of Compressible Fluid Flow, 1953, pp. 507–516.

J.D. Anderson, Jr., Modern Compressible Flow with Historical Perspective, 1982, pp. 277–286.

*Primary Examiner*—Teresa J. Walberg

[57] ABSTRACT

A nozzle for a sootblower is used to project a cleaning agent against the internal surfaces of a boiler for removing fireside deposit. The nozzle of the present invention incorporates a passageway having a convergent segment between its entrance end most narrow point, the throat. Extending from the throat to the nozzle's exit is an expansion chamber in which the cleaning fluid passing therein expands and drops in pressure to substantially ambient pressure. The flow streams of the jet of the cleaning agent discharged from the nozzle is essentially parallel to the center axis of the nozzle. Additionally, the nozzles can be mounted diametrically opposed or spaced along the longitudinal axis of the lance tube. Moreover, the nozzles mounted in a lance tube can be mounted flush with the outside surface of the lance tube, contoured to its shape.

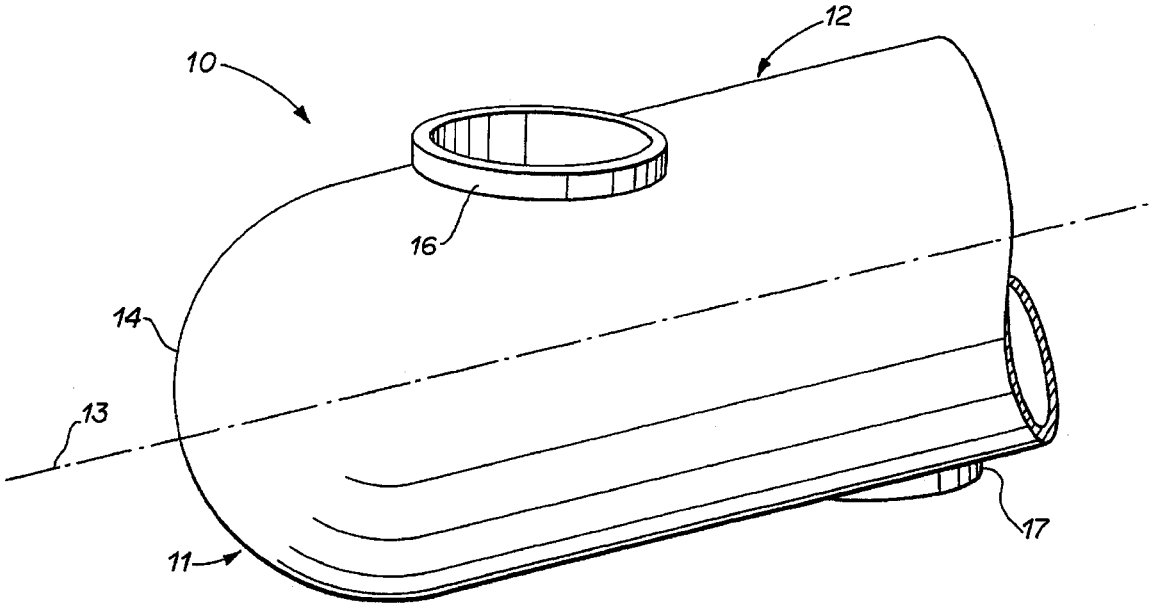

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, lines 11–24:

The accumulation of fireside deposits on the internal heating surfaces of boilers drastically reduces their thermal conductivity and efficiency and, if not removed, requires periodic shutdowns of the boiler for manual cleaning. The principal means for removing fireside deposit accumulation in boilers is a cleaning device known as a sootblower. A conventional sootblower typically [consist] *consists* of a lance tube having a plurality of nozzles which direct jets of a compressible cleaning agent under pressure, such as steam, gas or vapor, sidewise from the lance against the internal surfaces of the boiler. The cleaning effectiveness of a sootblower depends to a great degree on the nozzle design which controls the mass flow, exit speed and the jet decay characteristics of the exiting jets.

Column 3, lines 13–22:

In a second embodiment of the present invention, the controlled early expansion of the cleaning agent is produced by a companulate inner wall or surface defining the expansion chamber. The inner expansion [surface] *chamber* is comprised of a conical portion defined by a divergence angle and, in cross-section, a curvilinear portion mathematically defined[.]. The cleaning agent passing through the nozzle rapidly expands through the conical portion and is then redirected in the curvilinear portion. The expansion chamber merges with the discharge end portion.

Column 5, lines 9–16:

The main body 12 is usually about 8 inches long with an outside diameter of approximately 3.5 inches, a wall thickness of approximately 0.25 inches and an inside diameter of about 3.0 inches. [Body] *The main body* 12 is integrally joined to an otherwise conventional feeder tube, not shown, having an opposite end fixed to a motor driven carriage, not shown. The main body 12 is made of heat resistant material, such as stainless steel.

Column 5, lines 24–30:

Nozzles 16 and 17 are identical, each being a cylindrical shell machined from heat [resistance] *resistant* rod material, such as stainless steel rods, and are respectfully radially received in [space] *spaced*, circumferentially disposed holes in *main* body 12. The nozzles 16 and 17 are respectfully fixed in placed by welding or alternatively, the lance tube and nozzles can be cast to form an integral piece.

Column 5, lines 42–55:

The compressible cleaning agent [tinder] *under* pressure, such as steam, gas or vapor, passes through nozzles 22, 23 in the direction of arrows 33, entering entrance end 26 and thence through the converging section 34 defined by wall 28. At the throat 31, the cleaning agent reaches the local speed of sound. The speed is achieved by a reduction in the cleaning agent pressure. Beyond the throat area 31, the cleaning agent is further accelerated to speeds exceeding the speed of sound. The cleaning agent then passes into the expansion chamber 36 defined by wall 29 where the cleaning agent progressively expands, resulting in a corresponding drop in pressure throughout the length of expansion chamber 36. Thence, the cleaning agent exits the [nozzle] *nozzles* from the discharge [end] *ends* 27 of nozzles 22, 23.

Column 6, lines 24–36:

Limited by the inside diameter of conventional lance tube 21 and the opening in the boiler wall, the length $L_n$, 34, of the expansion chamber 36 of nozzles *22 and* 23 is limited, such that the cleaning agent passing through nozzles *22 and* 23 typically expands sufficiently for the pressure of the existing cleaning agent to be typically about 4 times that of the ambient pressure. Consequently, the discharging cleaning agent is "under expanded," resulting in an uncontrolled expansion of this cleaning agent outside the nozzle and a reduction in the available cleaning energy in the existing jet. Therefore, it is desirable to have a nozzle capable of allowing the cleaning agent passing through it to expand sufficiently, prior to its discharge, so that the pressure of the existing cleaning agent jet is substantially equal to the ambient pressure.

Column 7, lines 4–12:

In operation, a cleaning agent enters nozzle [41] *40* in the direction indicated by arrows 54 through opening 49 into a converging chamber defined by wall 46 and thence into throat 47. As with the prior art nozzles, the cleaning agent reaches a speed of sound at the throat 47. Having passed through the throat 47, the cleaning agent is discharged into the central portion of the upstream end of the expansion chamber or passage 51 where it expands and decreases in pressure[. Subsequently], *subsequently* exiting the nozzle 40 at discharge end 57.

Column 7, lines 13–34:

Referring to FIG. 3B, the typical stream lines for the flow field of the cleaning agent passing through nozzle 40 are illustrated by lines 61. As a flow field is initially established, a recirculating toroidal bubble 62 is formed in the junction of walls 53 and 52. As a result, the recirculating toroidal bubble 62 acts as a solid body such that the cleaning agent within the flow field slides by the recirculating toroidal bubble 62 as it passes from throat 47 through expansion chamber 51. Consequently, the cleaning agent rapidly expands in the portion of expansion chamber 51 adjacent to throat 47 earlier than the expansion achieved in conventional nozzles. Therefore, the cleaning agent jet discharged from nozzle 40 is substantially fully expanded so as to maximize the cleaning energy (PIP) in the jet. In order to achieve this effect, the length 63 of expansion chamber 51 must be greater than the length 64 of the recirculating toroidal bubble 62. In conventional operation, length 63 of the [divergent segment] *expansion chamber* is approximately 1.30 to 1.50 inches, 1.46 inches ideally. See Table II below. In addition of the fact that this nozzle provides rapid expansion, it also provides a gas stream existing nozzle 40 that is travelling parallel to the nozzle's axis α.

Column 8, lines 2–14:

In operation, a cleaning agent enters nozzle 70 through opening 76 into convergent zone 78 defined by wall 79 terminating at throat 77. The cleaning agent then passes through throat 77 into expansion chamber 82 defined by inner expansion surface 83, which extends from throat 77 to discharge end 74. The cleaning agent exits nozzle 70 at its discharge end 74. The early expansion of *the* cleaning agent in expansion chamber 82 of nozzle 70 is best explained by briefly stating the applicable theories of flow field then defining and analyzing four flow regions for half of the nozzle's passageway where a mirror image of this flow is found below the nozzle axis 89.

Column 8, lines 15–31:

The theory upon which the present invention operates is that, upon passing the throat 77 the gas exceeds the speed of sound and is supersonic. The flow through nozzle 70 is modeled as if it is emerging from a fictitious point source 0' as shown in FIG. 4B. Due to the change in angle ψ, denoted by numeral 86 and defining the *reaction* wall TB, an expansion wave is set up as shown by the heavy line 87 in FIG. 4B. The nozzle is chosen such that only a single reflection of this wave is permitted as indicated by point B, denoted by numeral 88. Also, the nozzle is chosen such that at the point of intersection of this reflected wave 87 and the axis 89 of the nozzle, shown here by point E which is denoted by numeral 91, is the point where full expansion occurs. The curvilinear *expansion* wall BC, in redirecting the flow to emerge parallel to the axis 89, prevents any appreciable reflection of these waves on the nozzle wall. At discharge end 74 inner expansion surface 83 is essentially cylindrical.

Column 9, line 22:

The slope of the *expansion* wall TB is given by:

Column 9, lines 34–39:

By varying $M_B<M_K<M_E$, it is possible to trace the expansion along BE. In so doing, the curve defining curvilinear *expansion* wall BC is obtained. This is done by solving the characteristic equations along the wave KL, leading to the coordinate of any point along BC, such as point L in FIG. 4B, [is given by] *wherein*:

Column 10, lines 8–23:

Referring to FIG. 4C and the division of nozzle [49] *70,* into flow regions, the interior channel of nozzle 70 is defined by passageway ACDO and is symmetrical about axis 89. Inlet region I, denoted by numeral 93 and defined by ATFO, is similar to that found in conventional nozzles. In region II, denoted by numeral 94 and defined by TBEF, the cleaning agent expands through the conical section defined by *reaction* wall TB. Within region II, *reaction* wall TB is defined by divergence angle ω denoted by numeral 96. Prior to exiting region II, the cleaning agent substantially fully expands, though the cleaning agent emerging from region II is no longer traveling parallel to the nozzle axis 89.

Column 10, lines 53–60:

An alternative mounting configuration to that shown in FIG. 1 is illustrated in FIG. 5. Lance tube 110 includes a pair of nozzles 111, 112 in diametrically opposite relation positioned coaxially along axis 113. The nozzles 111, 112 are constructed in accordance with rapid expansion nozzles as disclosed as the [first] *contour nozzle of the second* embodiment of the present invention [through] *though* the [contour] nozzle disclosed as the [second] *first* embodiment can also be mounted similarly.

AS A RESULT OF REEXAMINATION, IT HAS BEEN DETERMINED THAT:

Claims 12 and 13 are cancelled.

Claims 1, 14, 15–17, 20, 21, 27, 28, 34 and 35 are determined to be patentable as amended.

Claims 2–11, 18, 19, 22–26 and 29–33, dependent on an amended claim, are determined to be patentable.

1. A sootblower of the type having an elongated hollow lance tube having a longitudinal axis and insertable into a boiler for supplying a cleaning agent under pressure to the interior of the boiler, the improvement comprising:

a one piece nozzle mounted through one side of said lance tube for directing said cleaning agent in a sidewise direction from said lance tube;

said nozzle having a passageway through its central portion and through which said cleaning agent passes from said lance tube, said passageway having a central axis, an upstream entrance end having unobstructed communications with the interior of said lance tube and a downstream discharge end for directing said [fluid] *cleaning agent* exteriorly of said lance tube;

said nozzle having a converging inner surface adjacent to said entrance end and a throat intermediate the ends of said passageway, said inner surface converging toward said throat;

said nozzle having an expansion chamber downstream from said throat, said expansion chamber including a reaction wall having a first slope and an inner expansion wall having a second slope, wherein said first slope is greater than said second slope;

said [expansion chamber being adapted] *reaction wall defining a divergence angle relative to said central axis in a region immediately adjacent said throat, said divergence angle being predetermined* to permit said cleaning agent to expand rapidly immediately after passing through said throat in a controlled expanded condition such that the static pressure of the cleaning agent discharged from the discharge end of said nozzle is less than or equal to twice the ambient pressure surrounding said lance tube *for a blowing pressure greater than 200 psig*.

14. A process for directing a compressible cleaning agent against [a] an interior surface of a boiler comprising the steps of:

directing [said] *the* compressible cleaning agent under pressure *of at least 200 psig* along a confined path in a downstream direction;

passing [said] *the cleaning* agent *in a* sidewise *direction* of [said] *the* confined path progressively through a restricted area so as to impart increased velocity to [said] *the cleaning* agent as it emerges from [said] *the* restricted area and approaches a sonic speed;

rapidly expanding [said] *the cleaning* agent after it passes from [said] *the* restricted area into an expansion zone comprising a reaction wall *adjacent the restricted area* having a slope greater than 10 degrees with respect to a central axis of [said path, so as] *the sidewise direction to* accelerate the [expanding] *cleaning* agent *to a velocity in excess of said sonic speed* so that it progressively approaches ambient pressure [and a velocity in excess of the said sonic speed], and an inner expansion wall [that substantially redirects said] *having a slope less than the slope of the reaction wall for redirecting the cleaning* agent in a direction substantially parallel to [said path] *the sidewise direction* into ambient air and towards [said] *the* surface at a velocity in excess of said sonic speed after it has been expanded[,] into a columnar flow; and progressively forming [said] *the cleaning* agent into a column while directing [said] *the cleaning* agent out of its confined path and into ambient air [and] toward said surface.

15. The process defined in claim 14 wherein the step of rapidly expanding [said] *the* cleaning agent includes fully expanding [said] *the* cleaning agent prior to exiting.

16. A process for directing and expanding a compressible cleaning agent passing through a one piece sootblower nozzle *having a center axis, the process* comprising the steps of:

providing a cleaning agent under pressure *of at least 200 psig*;

directing and accelerating [said] *the* cleaning agent to a sonic speed as [said] *the* cleaning agent passes through a restricted area;

rapidly expanding and accelerating [said] *the* cleaning agent exiting the restricted area in a first part of an expansion zone adjacent and downstream of the restricted area and defined by *a* reaction wall having a [first] slope *in a region adjacent to the restricted area that is* greater than 10 degrees with respect to the center axis of the nozzle;

directing said cleaning agent in a direction parallel with the center axis of the nozzle in a second part of the expansion zone defined by an inner expansion wall having a [second] slope less than [said first] *the* slope *of the reaction wall*; and producing a columnar jet.

17. The process defined in claim 16 wherein the step of rapidly expanding [said] *the* cleaning agent includes fully expanding [said] *the* cleaning agent prior to exiting.

20. A sootblower of the type having an elongated hollow lance tube having a longitudinal axis and insertable into a boiler for supplying a cleaning agent under pressure to the interior of the boiler, the improvement comprising:

a nozzle mounted through one side of said lance tube for directing said cleaning agent in a sidewise direction from said lance tube said nozzle having a passageway through its central portion and through which said cleaning agent passes from said lance tube, said passageway having a central axis, an upstream entrance end in communication with the interior of said lance tube and a downstream discharge end for directing said [fluid] *cleaning agent* exteriorly of said lance tube;

said nozzle having a converging inner surface adjacent to said entrance end and a throat intermediate the ends of said passageway, said inner surface converging toward said throat;

said nozzle having an expansion chamber downstream from said throat, said expansion chamber having a reaction wall and an inner expansion wall;

said expansion chamber [being adapted to] *defining a divergence angle relative to said central axis in a region adjacent said throat, said divergence angle being predetermined to* permit said cleaning agent to expand rapidly immediately after passing through said throat in a controlled expanded condition such that the static pressure of the cleaning agent discharged from the discharge end of said nozzle is less than or equal to twice the ambient pressure surrounding said lance tube *for a blowing pressure greater than 200 psig*; and wherein the portion of said expansion chamber adjacent said discharge end *of said nozzle* is designed so as to form a columnar jet exiting said discharge end of said nozzle.

21. The sootblower defined in claim 20 wherein said [reaction wall forms a] divergence angle [of] *is* between about 10 degrees and about 90 degrees with respect to said central axis.

27. A sootblower of the type having an elongated hollow lance tube having a longitudinal axis and insertable into a boiler for supplying a cleaning agent under pressure to the interior of the boiler, the improvement comprising:

a nozzle mounted through one of said lance tube for directing said cleaning agent in a sidewise direction from said lance tube;

said nozzle having a passageway through its central portion and through which said cleaning agent passes from said lance tube, said passageway having a central axis, an upstream entrance end in communication with the interior of said lance tube and a downstream discharge end for directing said [fluid] *cleaning agent* exteriorly of said lance tube;

said nozzle having a converging inner surface adjacent to said entrance end and a throat intermediate the ends of said passageway, said inner surface converging toward said throat;

said nozzle having an expansion chamber downstream from said throat, said expansion chamber having a reaction wall *adjacent said throat* and an inner expansion wall;

said [expansion chamber being adapted] *reaction wall forming a divergence angle relative to said central axis in a region immediately adjacent said throat, said divergence angle being predetermined* to permit said cleaning agent to expand rapidly immediately after passing through said throat in a controlled expanded condition such that the static pressure of the cleaning agent discharged from the discharge end of said nozzle is less than or equal to twice the ambient pressure surrounding said lance tube *for a blowing pressure of at least 200 psig*; and an additional nozzle similar to said nozzle for forming a pair of nozzles and wherein said pair of nozzles are spaced apart along said central axis of said lance tube and are circumferentially disposed about 180 degrees apart so as to discharge sidewise of said lance tube in opposition directions.

28. The sootblower defined in claim 27 wherein said [reaction wall forms a] divergence angle [of] *is* between about 10 degrees [to] *and* about 90 degrees with respect to said central axis.

34. A sootblower of the type having an elongated hollow lance tube having a longitudinal axis and insertable into a boiler for supplying a cleaning agent under pressure to the interior of the boiler, the improvement comprising:

a nozzle mounted through one side of said lance tube for directing said cleaning agent in a sidewise direction from said lance tube;

said nozzle having a passageway through its central portion and through which said cleaning agent passes from said lance tube, said passageway having a central axis, an upstream entrance end in communication with the interior of said lance tube and a downstream discharge end for directing said fluid exteriorly of said lance tube;

said nozzle having a converging inner surface adjacent to said entrance end and a throat intermediate the ends of said passageway, said inner surface converging toward said throat;

said nozzle having an expansion chamber downstream from said throat, said expansion chamber having a reaction wall and an inner expansion wall;

said expansion chamber [being adapted] *having a shape in a region adjacent to said throat that is predetermined* to permit said cleaning agent to expand rapidly immediately after passing through said throat in a controlled expanded condition such that the static pressure of the cleaning agent discharged from the discharge end of said nozzle is less than or equal to twice the ambient pressure surrounding said lance tube *for a blowing pressure greater than 200 psig*; and a lance tube with an arcuate outer surface and wherein said discharge end of said nozzle is flush with said arcuate outer surface of said lance tube.

35. A sootblower of the type having an elongated hollow lance tube having a longitudinal axis and insertable into a boiler for supplying a cleaning agent under pressure to the interior of the boiler, the improvement comprising:

a nozzle mounted through one side of said lance tube for directing said cleaning agent in a sidewise direction from said lance tube;

said nozzle having a passageway through its central portion and through which said cleaning agent passes from said lance tube, said passageway having a central axis, an upstream entrance end in communication with the interior of said lance tube and a downstream discharge end for directing said [fluid] *cleaning agent* exteriorly of said lance tube;

said nozzle having a converging inner surface adjacent to said entrance end and a throat intermediate the ends of said passageway, said inner surface converging toward said throat;

said nozzle having an expansion chamber downstream from said throat, said expansion chamber having a reaction wall and an inner expansion wall;

said [expansion chamber being adapted] *reaction wall having a slope in a region immediately adjacent said throat that is predetermined* to permit said cleaning agent to expand rapidly immediately after passing through said throat in a controlled expanded condition such that the static pressure of the cleaning agent discharged from the discharge end of said nozzle is less than or equal to twice the ambient pressure surrounding said lance tube *for a blowing pressure greater than 200 psig*; and wherein said [expansion chamber] *reaction wall* includes an essentially flat radial surface adjacent to said throat and *said inner expansion wall includes an* essentially axially disposed circular surface of uniform diameter throughout the remainder of said [inner expansion wall] *expansion chamber*.

* * * * *